US006163114A

United States Patent [19]

Fischer et al.

[11] Patent Number: 6,163,114

[45] Date of Patent: Dec. 19, 2000

[54] STARTING CIRCUIT FOR LOW-PRESSURE DISCHARGE LAMP

[75] Inventors: Klaus Fischer, Friedberg; Ludwig Reiser, Gersthofen, both of Germany

[73] Assignee: Patent-Treuhand-Gesellschaft fuer elektrische Gluehlampen mbH, Munich, Germany

[21] Appl. No.: 09/362,907

[22] Filed: Jul. 29, 1999

[30] Foreign Application Priority Data

Aug. 26, 1998 [DE] Germany ..... 198 38 830

[51] Int. Cl.[7] ..... G05F 1/00

[52] U.S. Cl. ..... 315/291; 315/118; 315/307; 315/DIG. 5; 315/DIG. 7

[58] Field of Search ..... 315/118, 209 R, 315/224, 225, 291, 307, 309, DIG. 2, DIG. 5, DIG. 7

[56] References Cited

U.S. PATENT DOCUMENTS

| | | | |
|---|---|---|---|
| 4,647,817 | 3/1987 | Fahnrich et al. | 315/DIG. 7 |
| 5,051,666 | 9/1991 | Jensen | 315/307 |
| 5,063,490 | 11/1991 | Maechara et al. | 315/307 |
| 5,233,273 | 8/1993 | Waki et al. | 315/224 |
| 5,382,878 | 1/1995 | Secen et al. | 315/DIG. 7 |
| 5,404,083 | 4/1995 | Nilssen | 315/244 |
| 5,710,489 | 1/1998 | Nilssen | 315/309 |
| 5,757,145 | 5/1998 | Johnson et al. | 315/307 |
| 5,828,187 | 10/1998 | Fischer | 315/291 |
| 5,936,361 | 8/1999 | Yamashita et al. | 315/224 |

FOREIGN PATENT DOCUMENTS

| | | | |
|---|---|---|---|
| 0 483 082 | 4/1992 | European Pat. Off. | H05B 41/38 |
| 19546588 | 6/1997 | Germany | H05B 41/36 |
| 6-283142 | 10/1994 | Japan | H01J 61/52 |

OTHER PUBLICATIONS

"Halbleiterschaltungstechnik [Semiconductor Circuitry]" by U. Tietze, Ch. Schenk, 9th edition, Springer, section 26.1.5 (transistor as temperature sensor), pp. 897–901.

*Primary Examiner*—Don Wong
*Assistant Examiner*—Thuy Vinh Tran
*Attorney, Agent, or Firm*—Carlo S. Bessone

[57] ABSTRACT

In an operating circuit for a low-pressure discharge lamp, the lamp current is controlled depending on the lamp temperature or the luminous flux.

17 Claims, 1 Drawing Sheet

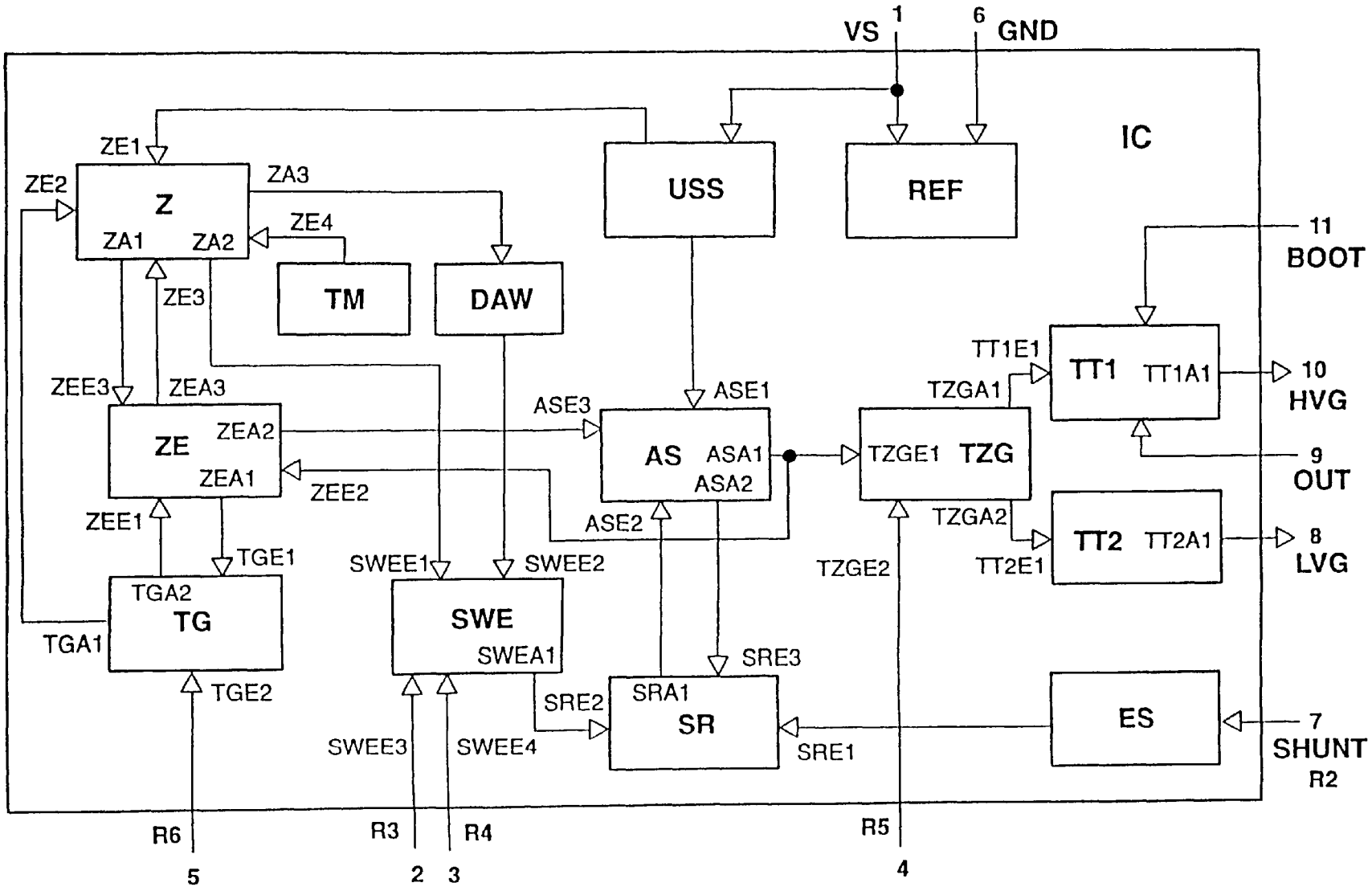
IC
11
BOOT
10
HVG
9
OUT
8
LVG
7
SHUNT
R2
6
GND
1
VS
TT1
TT1A1
TT2
TT2A1
ES
REF
TZG
TT1E1
TZGA1
TZGE1
TZGA2
TT2E1
TZGE2
R5
4
USS
AS
ASA1
ASA2
ASE1
ASE2
ASE3
SR
SRA1
SRE1
SRE2
SRE3
DAW
SWE
SWEA1
SWEE1
SWEE2
SWEE3
SWEE4
R4
3
2
R3
TM
ZE4
Z
ZA1
ZA2
ZA3
ZE1
ZE2
ZE3
ZE
ZEA1
ZEA2
ZEA3
ZEE1
ZEE2
ZEE3
TG
TGA1
TGA2
TGE1
TGE2
R6
5

STARTING CIRCUIT FOR LOW-PRESSURE DISCHARGE LAMP

BACKGROUND OF THE INVENTION

The present invention relates to an operating circuit for a low-pressure discharge lamp. It specifically concerns the behavior of a low-pressure discharge lamp immediately after ignition of the discharge in a starting phase, and also a starting circuit matched to this behavior.

A particular known feature of low-pressure discharge lamps containing Hg is that the luminous flux produced in the discharge is highly dependent on the temperature of the lamp. For the user, this means that, after it is switched on, the lamp provides a noticeably lower luminous flux for a certain time than when it is being operated continuously. This starting behavior is naturally irritating; however, in the field of lamps containing Hg, it has not been possible to remedy this to date with measures concerning the physics of the lamp itself.

One feasible way is illustrated in German Patent Specification 195 46 588.1 and corresponding U.S. Pat. No. 5,828,187. In this document, the difficulty described with the starting behavior of a low-pressure discharge lamp containing Hg has been tackled by increasing the lamp-current nominal value of a control IC that regulates the lamp current in operation during the starting phase. For further details, you are referred to the document.

In practice, various difficulties have arisen with such operating circuits. In particular, increased numbers of failures have been found.

The invention is thus based on the technical problem of further developing an operating circuit in terms of improved reliability and improved operating characteristics.

SUMMARY OF THE INVENTION

The invention solves this problem by means of a circuit for operating a low-pressure discharge lamp with a starting circuit for controlling the lamp current during a starting phase, characterized in that the starting circuit has a sensor device for a variable which is dependent on the luminous flux or the temperature of the lamp, and controls the lamp current depending on the luminous flux or the temperature of the lamp.

Although the cited document concerns compensation for excessively low luminous flux when operation starts by increasing the lamp current, the present invention is not to be understood as being restricted to this specific case. Instead, it is based generally on controlling the lamp current in a starting phase of a low-pressure discharge lamp.

BRIEF DESCRIPTION OF THE DRAWING

The drawing is a schematic diagram of an embodiment of the present invention.

DESCRIPTION OF PREFERRED EMBODIMENTS

The invention provides for the lamp current to be controlled in the starting phase depending on a measured parameter characterizing the operating state of the lamp. An operating state that differs from the continuous operating state and in fact characterizes the starting phase is then intended to cause the lamp current to be controlled, the result of which is a lamp luminous flux at least approximating the luminous flux in the continuous operating state. Specifically, the operating state can be detected in the starting phase by a lamp temperature which differs from the continuous operating temperature of the lamp or by a luminous flux which does not correspond to the desired continuous luminous flux. Particularly with the starting behavior, described above, of low-pressure discharge lamps containing Hg, an excessively low lamp temperature causes an excessively low luminous flux, which can be compensated for by increasing the lamp current in the starting phase.

However, the present invention departs from the concept of the document cited above in that control of the lamp current is dependent on a measured parameter which represents the luminous flux or the lamp temperature. Specifically, in the prior art described, a time period which, although it can be set when the circuit is designed, is then permanently predefined, is used for increasing the lamp current in a manner which is equally permanently predefined. In this case, although the increased lamp current is raised with a continuous ramp and is reduced at the end of the predefined time, the whole pattern of times for increasing, maintaining and reducing the increased lamp current and for the extent of the increase in terms of current level is permanent and invariable for individual cases, irrespective of the actual operating state of the lamp.

According to the invention, it has been found that this "inflexible" control of the lamp current does not merely result in relatively poor matching of the luminous flux in the starting phase. Above all, the inflexibly predefined lamp current increase whenever the lamp is started can cause the lamp or the operating circuit to be damaged. For example, when a low-pressure discharge lamp containing Hg is restarted after a short interruption in operation, the lamp is still warm from operation. Increasing the lamp current can then increase the operating temperature above the nominal temperature for continuous operation, so that the luminous flux of the lamp is reduced again on account of the excessive Hg vapor pressure. The result is that, for this case, the starting circuit achieves the exact opposite of the desired result. In addition, the increased temperature accelerates the deterioration and thus the probability of failure of the lamp and the electronic components in its immediate surroundings. A similar line of reasoning also applies to the rising temperature, caused by the increased lamp current, of the operating circuit even if it is not arranged immediately next to the lamp.

If, owing to particular circumstances, the lamp or the operating circuit has already overheated before restart, the lamp current increase which nevertheless takes place can result in destruction. This risk is also present if the lamp is repeatedly switched on and off for brief periods even if the surrounding conditions are otherwise normal.

The invention instead makes control of the lamp current and, in the example given, the lamp current increase dependent on the measured parameter characterizing the operating state of the lamp. Accordingly, the lamp current control can then be controlled on the basis of duration, relative increase or reduction or on the basis of sign as well as activation or deactivation. It is helpful to use one or more measured parameters which, directly or indirectly, characterize either the luminous flux of the lamp or the lamp temperature.

In a preferred embodiment, a temperature sensor is provided which does not measure the lamp temperature directly but measures a temperature which depends on the lamp temperature. This concerns, by way of example, measurement points in the lamp base and/or in the operating circuit or at other points which are thermally coupled to the lamp.

In a specific case, such a temperature sensor is designed to be integrated with a control IC for the operating circuit. Control ICs are preferred in this invention because the possibility exists for combination with a regulating circuit in the operating circuit. The starting circuit and the sensor device, i.e. the temperature sensor, can then also be integrated in the IC.

In addition, a photodetector may also be used which measures the luminous flux of the lamp. In this instance, detection of the luminous flux by means of the photodetector, at least in discharge lamps containing Hg, should preferably take place in addition to the temperature being detected. Otherwise, an overheating operating state cannot reliably be distinguished from a cold start because the luminous flux decreases with an increased Hg vapor pressure in exactly the same way as with excessively low Hg vapor pressure.

Instead of the lamp luminous flux, the running voltage of the lamp can also be measured in the operating circuit. In discharge lamps containing Hg, the same applies here as for the dependency of the luminous flux on the lamp temperature.

In a simple and effective variant of the invention, the lamp current can be controlled by varying the time period for a lamp current increase or reduction. In the more complex case, this takes place together with variation of the extent of the current strength, but happens exclusively in the simplest case. Deactivation can be achieved by setting the time period to zero or very much shortening it. In this case, preferred embodiments for the necessary timer circuit, on the one hand, are a combination of a clock-signal generator and a counter with possible variation of the clock frequency or of the final counter reading of the counter, the said reading determining the time. The range of the clock input to the counter can also be varied, so that the counter accordingly counts at a higher point and thus reaches a value defining a time period earlier. On the other hand, a combination comprising an RC element and a comparator is feasible, the time constant of the RC element and the threshold of the comparator again being variable.

A further refinement of the invention relates to the temperature detection already mentioned above. Particularly if there is insufficient thermal coupling between the lamp and the measurement point, which, for technical reasons, may possibly desirably be outside the lamp, the measurement point can be arranged on a component which produces heat independently of the lamp during lamp operation. This component may be, for example, part of the control IC mentioned or the entire IC. However, power transistors for an oscillator and similar heat-producing components are also feasible, for example.

In the following text, a specific exemplary embodiment is described with reference to the drawing, and the individual features of the exemplary embodiment may also be essential to the invention in different combinations or individually.

For the sake of simplicity, this exemplary embodiment is based on the circuit described in the cited document DE 195 46 588.1 and corresponding U.S. Pat. No. 5,828,187. Hence, reference is made to this document with regard to the basic manner of operation, control of the lamp current in particular, and the design of the operating circuit and the control IC. The corresponding disclosure is incorporated here by way of reference.

In this case, the drawing corresponds to FIG. 2 of the cited U.S. patent and shows the functional block diagram of the control IC therein that has been expanded, according to the present invention, in comparison with the cited FIG. 2 of the U.S. patent.

A new block TM for a temperature sensor has been inserted into the block diagram and detects the temperature of the silicon IC shown. The block TM is connected by means of a new input ZE4 to the counter Z, which is already known from the cited application. Both blocks are situated in the top left-hand corner of the drawing.

For actually designing such a temperature sensor, various options are known to a person skilled in the art. In particular, highly temperature-dependent electrical variables (e.g. leakage currents or diode forward voltages) can be compared with temperature-compensated reference variables. Specific examples of appropriate practical transistor circuits are illustrated, for example, in "Halbleiter-schaltungstechnik (Semiconductor Circuitry)" by U. Tietze, Ch. Schenk, 9th edition, Springer, section 26.1.5 (transistor as temperature sensor), page 897–901.

In the exemplary embodiment shown, the temperature sensor TM compares the measured value with a reference value in order to determine a digital signal whose two possible values (1 or 0) represent an IC temperature above or below the reference variable. This digital signal is input into the input ZE4 of the counter Z.

The counter Z reacts to the value of the signal from the temperature sensor TM by the clock pulses, predefined by the clock-signal generator TG already known from the prior application, for counting up the counter Z occurs at a different position (in terms of a multi-digit binary number) or with a different range. The clock pulses are thus not transferred to the least significant element but to an element which is more significant by a predetermined factor.

The counter Z can comprise, for example, a chain of a number of flip-flops (e.g. 22) whose output frequency halves the input frequency in each case. Inputting the clock pulses at the thirteenth flip-flop, for example, instead of the first flip-flop, effectively shortens the time by a factor of $2^{12}$ until a specific counter reading is reached.

However, this shortening of the time affects only the times linked to the starting phase and not the length of time for the preheating and ignition phase. To refer to FIG. 4*a* of the cited application, the length of time TV for the preheating phase and TZ for the ignition phase thus remains unchanged until ignition is detected. Preheating is fundamentally necessary and largely independent of the general operating temperature of the lamp.

In the circuit shown in the drawing, this means that the counting properties of the counter Z are varied by the signal from the temperature sensor TM via the input ZE4 only if the ignition detector ZE "has informed" the counter, via the input ZE3, that the preheating and ignition process has now ended. The essential advantage of the solution according to the invention is that the rest of the circuit remains completely unchanged from a technical point of view, and so the other conventional nominal value stages (illustrated in FIG. 4*a* of the cited German reference) are run through so quickly that the starting phase is practically dispensed with.

What is claimed is:

1. Circuit for operating a low-pressure discharge lamp with a starting circuit for controlling the lamp current during a starting phase that includes a counter connected to a clock-signal generator, wherein the starting circuit has a sensor connected to the counter for a variable which is dependent on the luminous flux or the temperature of the lamp and controls the lamp starting current during starting of the lamp depending on the sensed luminous flux or temperature of the lamp.

2. Circuit according to claim 1, in which the sensor has a temperature sensor arranged in a base of the lamp or in a lamp operating circuit for measuring a temperature which is dependent on the lamp temperature.

3. Circuit according to claim 2, in which the temperature sensor detects the temperature of a component which produces heat during lamp operation.

4. Circuit according to claim 3, in which the starting circuit controls the lamp current by varying the duration of the starting phase.

5. Circuit according to claim 4, in which the duration is varied by varying a counting range of input of clock pulses from the clock-signal generator into the counter.

6. Circuit according to claim 2, in which the starting circuit controls the lamp current by varying the duration of the starting phase.

7. Circuit according to claim 1, wherein the sensor senses a variable which is dependent on the luminous flux of the lamp and the starting circuit controls the lamp starting current during starting of the lamp in response to the sensed luminous flux of the lamp.

8. Circuit for operating a low-pressure discharge lamp with a starting circuit for controlling the lamp current during a starting phase, wherein the starting circuit has a sensor for a variable which is dependent on the luminous flux or the temperature of the lamp and controls the lamp starting current during starting of the lamp depending on the sensed luminous flux or temperature of the lamp;

in which the sensor has a temperature sensor arranged in a base of the lamp or in a lamp operating circuit for measuring a temperature which is dependent on the lamp temperature; and in which the starting circuit is integrated with the temperature sensor in a control IC for the operating circuit.

9. Circuit according to claim 8, in which the starting circuit controls the lamp current by varying the duration of the starting phase.

10. Circuit according to claim 9, in which the duration is varied by varying a counting range of input of clock pulses from a clock-signal generator into a counter.

11. Circuit according to claim 8, in which the temperature sensor detects the temperature of a component which produces heat during lamp operation.

12. Circuit for operating a low-pressure discharge lamp with a starting circuit for controlling the lamp current during a starting phase, wherein the starting circuit has a sensor for a variable which is dependent on the luminous flux or the temperature of the lamp and controls the lamp starting current during starting of the lamp depending on the sensed luminous flux or temperature of the lamp;

in which the sensor has a temperature sensor arranged in a base of the lamp or in a lamp operating circuit for measuring a temperature which is dependent on the lamp temperature;

in which the temperature sensor detects the temperature of a component which produces heat during lamp operation; and in which the component is a control IC for the operating circuit or is part of the control IC.

13. Circuit according to claim 12, in which the starting circuit controls the lamp current by varying the duration of the starting phase.

14. Circuit according to claim 13, in which the duration is varied by varying a counting range of input of clock pulses from a clock-signal generator into a counter.

15. Circuit for operating a low-pressure discharge lamp with a starting circuit for controlling the lamp current during a starting phase, wherein the starting circuit has a sensor for a variable which is dependent on the luminous flux or the temperature of the lamp and controls the lamp starting current during starting of the lamp depending on the sensed luminous flux or temperature of the lamp;

wherein the starting circuit controls the lamp current by varying the duration of the starting phase and in which the duration is varied by varying a counting range of input of clock pulses from a clock-signal generator into a counter.

16. Circuit for operating a low-pressure discharge lamp with a starting circuit for controlling the lamp current during a starting phase, wherein the starting circuit has a sensor for a variable which is dependent on the luminous flux or the temperature of the lamp and controls the lamp starting current during starting of the lamp depending on the sensed luminous flux or temperature of the lamp, the sensor having a temperature sensor arranged in a base of the lamp or in a lamp operating circuit for measuring a temperature which is dependent on the lamp temperature, in which the starting circuit controls the lamp current by varying the duration of the starting phase and in which the duration is varied by varying a counting range of input of clock pulses from a clock-signal generator into a counter.

17. Circuit for operating a low-pressure discharge lamp with a starting circuit for controlling the lamp current during a starting phase, wherein the starting circuit has a sensor for a variable which is dependent on the luminous flux or the temperature of the lamp and controls the lamp starting current during starting of the lamp depending on the sensed luminous flux or temperature of the lamp; and wherein the sensor senses a variable which is dependent on the temperature of an integrated circuit that controls starting the lamp and the starting circuit controls the lamp starting current during starting of the lamp in response to the sensed temperature of the integrated circuit.

* * * * *